United States Patent [19]

Biever et al.

[11] Patent Number: 4,896,140

[45] Date of Patent: Jan. 23, 1990

[54] DISPLAY TABLE SECURITY SYSTEM

[76] Inventors: Dale E. Biever, 54 Douglass St., Boyertown, Pa. 19512; Lee M. Frank, Sr., 6337 Evelyn, Rutherford Heights, Harrisburg, Pa. 17111

[21] Appl. No.: 294,753

[22] Filed: Jan. 9, 1989

[51] Int. Cl.[4] ..... G08B 13/14

[52] U.S. Cl. ..... 340/568; 340/650; 340/651; 340/652

[58] Field of Search ..... 340/568, 652, 650, 651

[56] References Cited

U.S. PATENT DOCUMENTS 3,596,265 7/1971 Garland ..... 340/568

3,972,039 7/1976 Marshall ..... 340/568

*Primary Examiner*—Glen R. Swann, III

*Attorney, Agent, or Firm*—Edmund M. Jaskiewicz

[57] ABSTRACT

A control module is connected to a table strip having a number of jacks. A sensor probe which consists of a sensor detector and a sensor cable has at the end of the cable a plug which is connected to the table strip jack. Each sensor cable is provided with a continuity circuit and a floating circuit such that cutting of the cable or shorting of the cable will energize an indicator circuit and an alarm annunciator in the control module.

6 Claims, 3 Drawing Sheets

DISPLAY TABLE SECURITY SYSTEM

The present invention relates to an electrical security system having a number of cable sensor detectors each connected to individual articles on display which are to be protected, more particularly, to such a security system which will readily detect and sound an alarm upon any disruption or attempts to short circuit the sensor cable.

BACKGROUND OF THE INVENTION

Unauthorized removal or actual theft of merchandise from a display counter or the like has been an aggravating and long-time problem particularly for retail stores and merchants who display small but valuable items of merchandise in such a manner that the buying public is allowed to handle or try out the merchandise. Such merchandise is generally small and easily movable and may consist of small radios, electrical appliances and tools of all kinds, various forms of electronic equipment and more valuable items such as jewelry. Such goods may be easily removed by unscrupulous persons, especially when the premises are crowded and the sales personnel are too busy to watch every item. This problem of proper protection is particularly magnified for dealers in antique firearms and other weapons which are generally displayed on open tables usually in congested and crowded environments such as would be encountered in antique shows and flea markets. A potential buyer of an antique firearm, for example, would want to handle and examine closely the firearm prior to any purchase. While desiring to afford such purchasers every opportunity to examine goods, the dealer at the same time finds it difficult to adequately safeguard and watch all of his merchandise, particularly under the crowded conditions described above.

Various forms of electrical alarm devices have been proposed wherein a long electric wire is looped through a portion of the merchandise and made a part of an alarm system so that if the wire is cut or broken in order to remove the goods an alarm is sounded. Such loop segments can be made at virtually any required lengths so as to permit handling of the goods for normal customer inspection without danger of inadvertently actuating any alarm system. Such systems are generally in the form of a continuity circuit so that severing of the cable would actuate the alarm. The principal difficulty with such systems is that they can be defeated by a "jumper" wire clipped to each side of an intended cut of the conductor.

In U.S. Pat. No. 3,972,039 it has been proposed to overcome the effects of a "jumper" by providing a further wire in the two wire conductor connected to the protected article. This further wire is twisted with the other two wires and produces an alarm when shorted to one of the other wires. This proposal requires that an electrical connection be made between the third wire and the other two wires in the conductor in order to transmit an alarm. However, the twisted wires would cause false triggering of the system due to the inductive effect of the twisted wires picking up static and R.F. fields. While this patent states that unauthorized use of a test meter would actuate the alarm, this is not true today since present state of the art digital test equipment does not draw any current from the system. Thus, this prior art system would not be effective in today's market.

It is therefore the principal object of the present invention to provide a novel and improved electrical security system for individual articles on display.

It is another object of the present invention to provide such a security system wherein each article is connected by a sensor detector cable to an alarm system which is actuated by any attempts to cut the cable or interfere physically in any way with the cable.

It is a further object of the present invention to provide such a security system wherein the sensor detector cable includes both a continuity circuit and a floating circuit. It is an additional object of the present invention to provide such an electrical security system which is dependable in operation, simple and inexpensive to install and operate, and capable of indicating any attempts to remove an article without interfering with customer inspection of the article.

SUMMARY OF THE INVENTION

According to one aspect of the present invention, an electrical security system for individual articles on display may comprise a sensor detector engaged by an article on display and responsive to a predetermined movement of the article or to a predetermined condition of the sensor detector itself. An indicator sub system having an alarm annunciator is connected to the sensor detector by flexible means comprising a continuity circuit and a floating circuit. The indicator sub-system has two indicator circuits respectively connected to the continuity circuit and the floating circuit so as to be responsive to any interruption of the continuity circuits and to a predetermined electrical condition in the floating circuit. The two indicator circuits are connected to an alarm annunciator which is actuated by either one or both of the indicator circuits.

The sensor detector may comprise a magnetic detector, a pressure plate detector or a sensor cable having a loop connected to the article.

BRIEF DESCRIPTION OF THE DRAWINGS

Other objects and advantages of the present invention will be apparent upon reference to the accompanying description when taken in conjunction with the following drawings, which are exemplary, wherein.

DESCRIPTION OF THE PREFERRED EMBODIMENT

Proceeding next to the drawings wherein like reference symbols indicate the same parts throughout the various views, a specific embodiment and modifications of the present invention will be described in detail.

Figure 1:
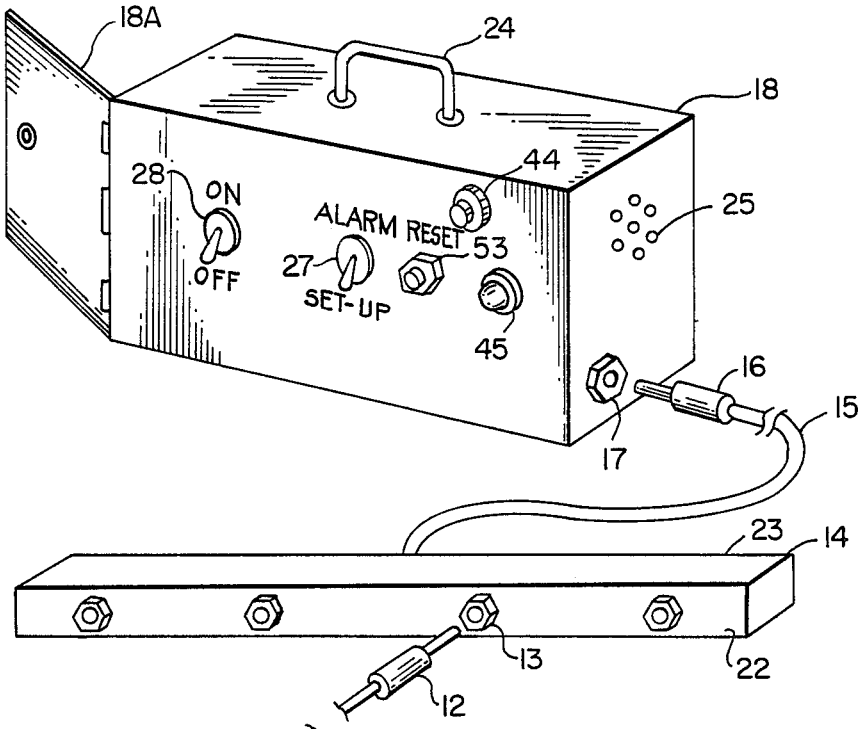
FIG. 1 is a view of the security system of the present invention generally as arranged for use with several of the components being shown in perspective.

The table security system according to the present invention as illustrated in FIG. 1 comprises a sensor detector 10 which in this particular embodiment is a loop at the end of a sensor cable 11 provided with a jack 12 which is inserted into a plug 13 in a table strip 14. The table strip is in turn connected by an electric conductor 15 and a jack 16 to a plug 17 in a control module 18.

Figure 2:
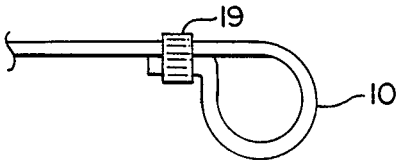
FIG. 2 is a plan view of the loop formed at the end of the sensor cable detector as seen in FIG. 1.

The loop detector 10 is shown in greater detail in FIG. 2 and comprises an end of the sensor cable being curved back against the cable and crimped in position with a metal crimp 19. In order to attach this loop end to an article to be protected such as, for example, a hand firearm 20 as shown in FIG. 1, the cable is looped around the trigger guard 21 of the firearm 20 and the jack end then passed through the loop 10 to secure the firearm or the loop 10 may be crimped in position around the trigger guard 21 as shown in FIG. 1.

The table strip 14 has a front side 22 upon which are mounted a plurality of plugs 13 for the sensors. The strip 14 also has a rear side indicated at 23 and has a like plurality of sockets thereon for cable sensors. Thus, in this particular embodiment the table strip may have eight sensor detectors connected to it. However, the length of the strip may be increased so as to accommodate a larger number of plugs or sensors.

The jack 12 at the end of the sensor cable 11 is a 3-prong jack to which three Teflon coated wires which are not twisted or exposed are respectively connected. Two of the wires form a continuity or closed loop circuit such that any cutting of the cable will interrupt the circuit and, at the same time, the third wire defines a floating circuit.

The control module 18 is relatively small in size in that its longest dimension, i.e. the length, is about 12 inches. The control module 18 has a handle 24 to facilitate carrying of the module and a lockable hinged panel door 18 A to enclose and protect the controls. The module is provided with a horn 25 which constitutes an audio alarm–and lights 44 and 45 which constitute a visual indicator. A selector switch 27 enables selection of either the audio alarm or visual set-up indicators depending on the circumstances. There is an on-off switch 28 and a circuit reset button 53.

Figure 3:
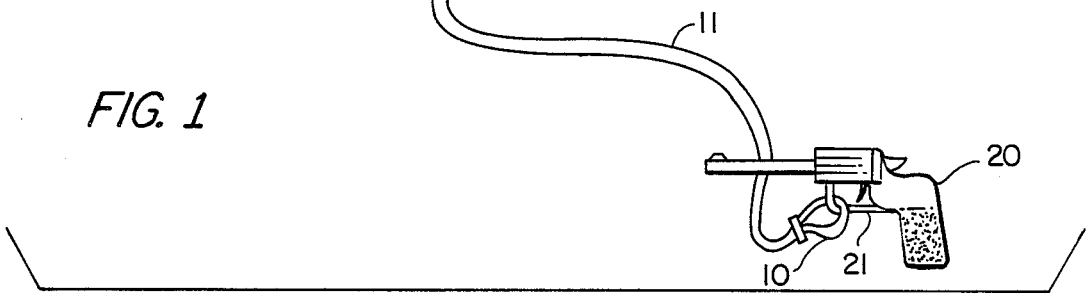
FIG. 3 is a side elevational view of a pressure detector attached to the end of the sensor detector cable.
Figure 3:
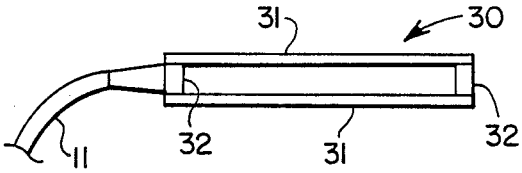

In place of the loop sensor detector 10, a pressure plate detector may be employed such as illustrated in FIG. 3. The pressure plate detector is indicated generally at 30 and comprises a pair of spaced thin copper strips or plates 31 separated by insulating material 32. The article to be protected is positioned on the strips and forces the copper strips to make contact. When the article is removed, an alarm will be sounded.

Figure 4:
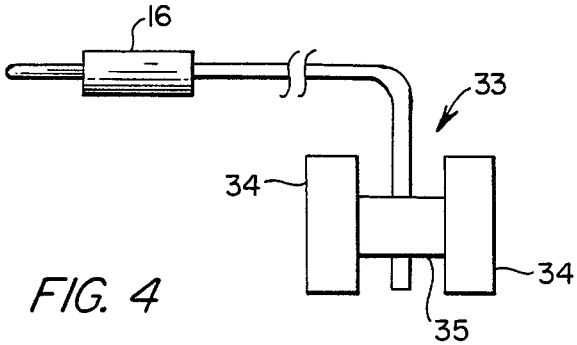
FIG. 4 is a side view of a magnetic detector attached to the end of the cable sensor detector.

Another form of a sensor detector is a magnetic sensor which is generally indicated at 33 in FIG. 4. The detector 33 comprises a pair of magnets 34 between which is a microswitch 35. The entire probe head consisting of the magnets and microswitch may be molded in plastic. The magnetic sensor probe functions by being attached to a metal surface. The contacts of the microswitch are closed to form continuity. Should the sensor detector be removed, the magnetic switch will open and the alarm will sound.

The control module 18 is preferably provided with four jacks 17 so as to be able to be connected to four different table strips 14. Each jack 17 is connected to an indicator circuit 36 and these circuits are all located within the control module 18 as indicated in FIG. 5.

Figure 5:
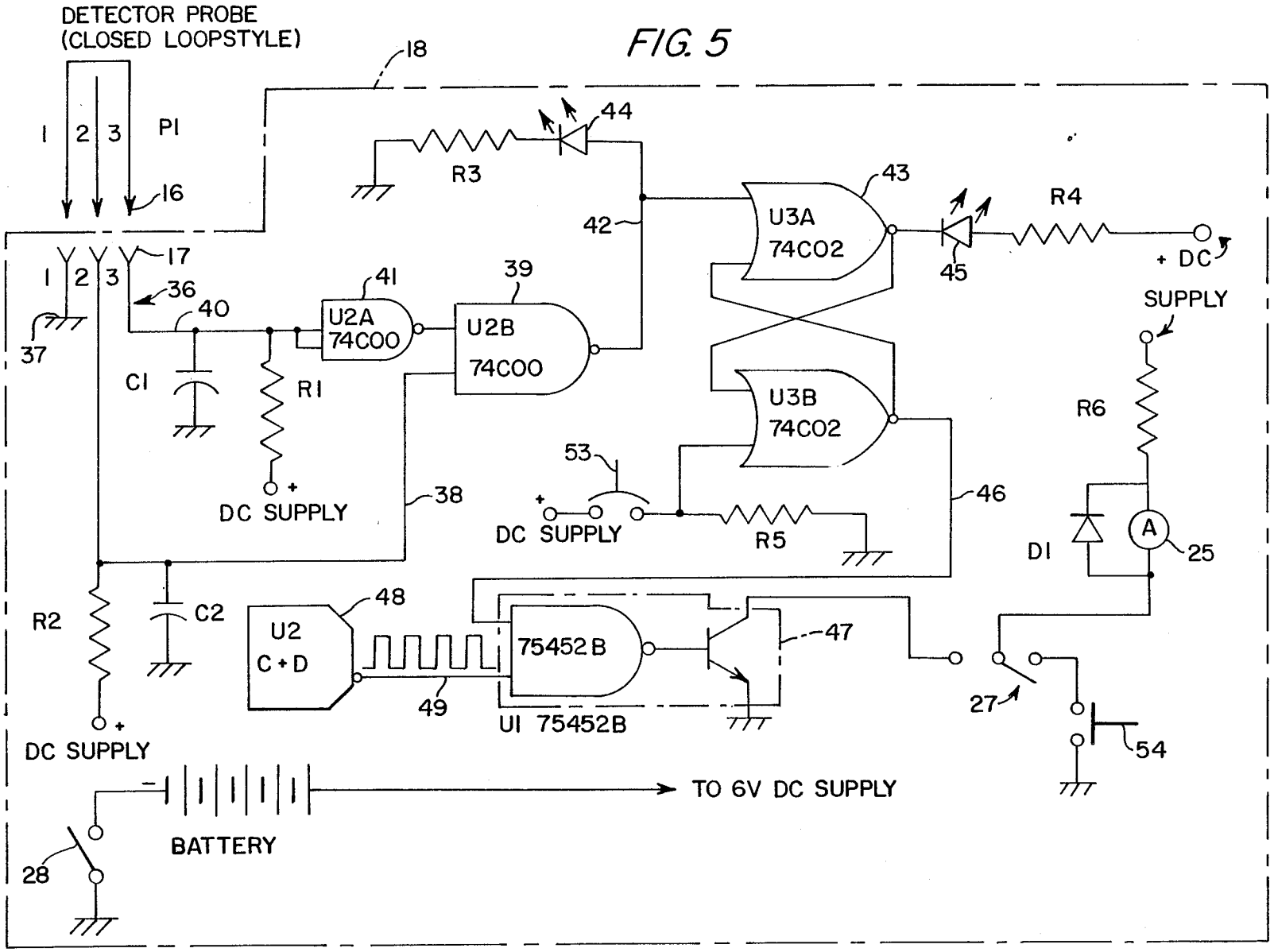
FIG. 5 is a schematic diagram showing the electrical circuit incorporated in the present invention.

Each jack 17 receives a 3-prong plug indicated schematically at 16 in FIG. 5. In plug 16, the wires 16-1 and 16-3 constitute the continuity circuits and the wire 16-2 constitutes the floating circuit. These particular wires are respectively connected to the circuits 17-1, 17-2 and 17-3 in the control module. The entire system within the module incorporates the 74C00 Digital Logic Family made by many of the leading integrated circuit manufacturers. Power is supplied by a 6 volt Ni-Cad battery.

Within the module 18 the lead 17-1 is connected to ground at 37 and the lead 17-2 connected to lead 38 and to a 74C00 2-input NAND gate 39. A resistor R-2 is connected between the wire 38 and the +supply DC source and there is also a by-pass capacitor C-2.

Figure 6:
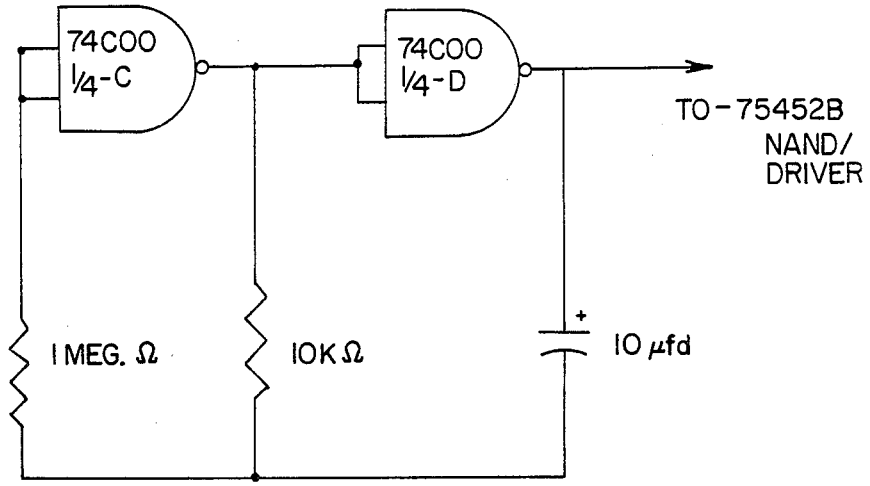
FIG. 6 is a schematic diagram showing the pulse generator in FIG. 5.

The lead 17-3 is connected by a wire 40 through a part of 74C00 used as an inverter 41 to the part of 74C00 used as the NAND gate 39. A resistor R-1 is connected between the wire 40 and the + supply DC source and there is also a by-pass capacitor C-1. The gate 39 is then connected by a wire 42 to a R/S flip-flop 13, to which is connected an LED fault indicator 44 and an LED reset indicator 45, and then to the power source. The flip-flop 43 is also connected by wire 46 to a control gate 47 comprising a peripheral driver 75452B. A pulse generator 48 made from the remaining sections C and D of 74C00 inputs through wire 49 to control gate peripheral driver 47 as shown in FIG. 6. The alarm horn 25 is pulsated by the action of gate driver 47 and is also connected to a current limiting resistor R-6. All of the circuits operate from the 6 volt DC source.

There may be four or more jacks 17 located in the control module 18 to receive the plugs from the table strips. Each of these jacks are connected by the same circuitry to the gate 39.

If an attempt is made to short out or cut any sensor detector probe or to move the system control unit, the system alarm will be activated in the following manner:

If a sensor detector which is plugged into 17-3 is cut, the input to inverter 41 (74C00) will be pulled to a high logic level by resistor R-1. Inverter 41 (74C00 A) will output a low logic level to gate 39 (74C00 B). Gate 39 will output a high logic level to R/S flip-flop 43 which will place a constant high logic level on control gate 47. Pulses from timer 48 will activate gate 47, outputting a pulsed voltage switch level, thus activating the alarm horn 25. This pulsed alarm will remain active until the operator places switch 27 in the set-up position. The operator will then replace the damaged sensor probe which will cause the indicator 44 to go out. The operator will then actuate reset switch 53, which will cause indicator 45 to go out, and activate the alarm horn 25 by throwing switch 27 into the alarm position.

If an attempt is made to short out a sensor probe, the floating logic high wire will be pulled to logic low, activating gate 39. From this point, the sequence of logic events is identical as described above. System power and logic level voltages are provided by rechargeable batteries as described above. LED indicator 44 is used for system set-up to indicate a faulty sensor or probe. LED indicator 45 is used to indicate if the system needs to be reset after activation. The switch 27 is used for system set-up to deactivate the alarm horn. A pressure switch 54 is provided on the system access door 18A to alert the operator if he has failed to activate the system. The audio alarm 25 will sound if the alarm is not properly activated. An additional switch can be incorporated to activate the alarm horn if an attempt is made to move or tamper with the control module.

Thus, it can be seen that the present invention has disclosed a table security system which in the same sensor cable employs a continuity circuit and a floating circuit. The continuity circuit will be actuated upon any cutting of the cable and the floating circuit will be actuated if any attempt is made to short the cable. The security system may be employed with suitable sensor detectors, examples of which are the loop, magnetic sensor and pressure plate sensor as disclosed herein. The control module is secured by a lock and once it has been actuated the proper key must be used to gain access to the system and reset the system for repeated use. Dummy plugs must be inserted in all jacks 17 in the control module 18 and all jacks 13 in the table strip 14 which are not in use.

It will be understood that this invention is susceptible to modification in order to adapt it to different usages and conditions, and accordingly, it is desired to comprehend such modifications within this invention as may fall within the scope of the appended claims.

What is claimed is:

1. A security system for individual articles on display comprising a sensor detector engaged by an article on display and responsive to a predetermined movement of said article or to a predetermined condition of the sensor detector itself, an indicator sub-system having an alarm annunciator, means for connecting said sensor detector to said indicator sub-system and comprising a continuity circuit and a floating circuit, said indicator sub-system comprising a first indicator circuit connected to said continuity circuit and responsive to interruption of said continuity circuit and a second indicator circuit connected to said floating circuit and responsive to an interruption of said floating circuit, said alarm annunciator being connected to said first and second indicator circuits and actuated by either one or both of said indicator circuits.

2. A security system as claimed in claim 1 wherein said connecting means comprises first and second wires defining said continuity circuit and a third wire defining said floating circuit, said wires being free of twisting or exposure.

3. A security system as claimed in claim 1 wherein said continuity circuit is normally held at a low condition and said floating circuit is normally held at a high condition, said continuity circuit will go high when its continuity is interrupted, said floating circuit will go low when said floating circuit is shorted.

4. A security system as claimed in claim 3 wherein said alarm annunciator is actuated by a high condition in said continuity system.

5. A security system as claimed in claim 4 wherein a low condition of said floating circuit will actuate said alarm annunciator.

6. A security system as claimed in claim 3 and comprising means in said indicator system for resetting said system after said alarm annunciator has been actuated.

* * * * *